US008881464B1

(12) United States Patent
Huckeba

(10) Patent No.: US 8,881,464 B1
(45) Date of Patent: Nov. 11, 2014

(54) WEATHERGUARD DOOR SEALING DEVICE WITH REPLACEABLE SEAL

(71) Applicant: Melken L.L.C., Sheridan, WY (US)

(72) Inventor: Ken Huckeba, Sheridan, WY (US)

(73) Assignee: Melken L.L.C., Sheridan, WY (US)

( * ) Notice: Subject to any disclaimer, the term of this patent is extended or adjusted under 35 U.S.C. 154(b) by 0 days.

(21) Appl. No.: 14/164,421

(22) Filed: Jan. 27, 2014

(51) Int. Cl.
*E06B 7/232* (2006.01)

(52) U.S. Cl.
USPC ..... 49/496.1; 49/197; 49/489.1

(58) Field of Classification Search
USPC ..... 49/475.1, 197, 199, 482.1, 489.1, 49/493.1, 496.1, 478.1, 458, 459
See application file for complete search history.

(56) References Cited

U.S. PATENT DOCUMENTS

| | | | | | |
|---|---|---|---|---|---|
| RE16,800 | E | * | 11/1927 | Polachek et al. | 49/209 |
| 1,812,822 | A | * | 6/1931 | Doering | 49/424 |
| 2,570,523 | A | * | 10/1951 | Clerk | 49/121 |
| 2,608,277 | A | * | 8/1952 | Storms | 49/438 |
| 2,612,664 | A | | 10/1952 | Sidden | |
| 2,949,651 | A | | 8/1960 | Hill | |
| 3,324,598 | A | | 6/1967 | Tinlow et al. | |
| 3,374,580 | A | | 3/1968 | Ruff | |
| 3,535,824 | A | * | 10/1970 | Kessler | 49/475.1 |
| 4,096,665 | A | * | 6/1978 | Ellingson, Jr. | 49/475.1 |
| 4,497,136 | A | | 2/1985 | Khallil | |
| 4,690,862 | A | * | 9/1987 | Hoffmann | 428/318.6 |
| 4,931,339 | A | * | 6/1990 | Malcolm-Brown | 428/71 |
| 4,957,301 | A | * | 9/1990 | Clay et al. | 277/345 |
| 5,259,143 | A | * | 11/1993 | Mitchell et al. | 49/27 |
| 5,435,104 | A | * | 7/1995 | Dietrich | 49/493.1 |
| 5,784,834 | A | * | 7/1998 | Stutzman | 49/475.1 |
| 6,167,657 | B1 | * | 1/2001 | Burge et al. | 49/496.1 |
| 6,173,533 | B1 | * | 1/2001 | Cittadini et al. | 49/478.1 |
| 6,374,567 | B1 | * | 4/2002 | Mullet | 52/716.1 |
| 6,772,560 | B2 | * | 8/2004 | Dischiant et al. | 49/496.1 |
| 6,772,561 | B1 | | 8/2004 | Berger, Jr. | |
| 6,928,696 | B2 | * | 8/2005 | Wartman | 16/99 |
| 7,089,990 | B2 | * | 8/2006 | Hormann et al. | 160/201 |
| 8,146,985 | B2 | * | 4/2012 | Nelson | 296/146.8 |
| 2005/0223647 | A1 | | 10/2005 | Stutzman et al. | |

OTHER PUBLICATIONS

Home Depot Aluminum and Vinyl Garage Door Bottom, www.homedepot.com, Nov. 22, 2011.
Its easy being green Aluminum & Santoprene Weather Strip, www.itseasybeinggreen.com, Nov. 22, 2011.
Hardware and Tools.com,Aluminum Plus Tubular Vinyl Strip Door Set, www.hardwareandtools.com, Nov. 22, 2011.

(Continued)

*Primary Examiner* — Jerry Redman
(74) *Attorney, Agent, or Firm* — Antoinette M. Tease

(57) ABSTRACT

A weatherguard door sealing device comprising a single piece of metal with an outer leg, receiving leg, center section, first and second planar surfaces, first and second diagonal surfaces, and two inner reinforcing legs. The first planar surface connects the outer leg to the first diagonal surface, the first diagonal surface connects the center section to the first planar surface, the second planar surface connects the receiver leg to the second diagonal surface, and the second diagonal surface connects the center section to the second planar surface. The receiver leg comprises a receiver channel for receiving a sealing element. The two inner reinforcing legs are parallel to each other and extend perpendicularly from the center section. The thickness of the center section is greater than the thickness of the first and second planar surfaces and the first and second diagonal surfaces.

15 Claims, 15 Drawing Sheets

(56) References Cited

OTHER PUBLICATIONS

Lowes Door Weather Strip: www.lowes.com. Nov. 22, 2011.

Aluminum Weather Strip Seal, www.tradekd.com, Nov. 22, 2011.

Door Kit with Aluminum Carrier, www.conservationmart.com, Nov. 22, 2011.

* cited by examiner

FIGURE 4
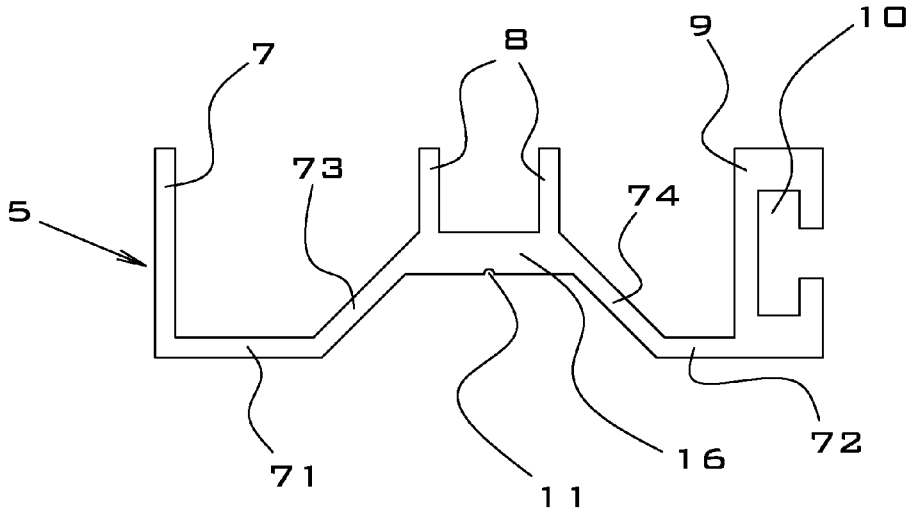
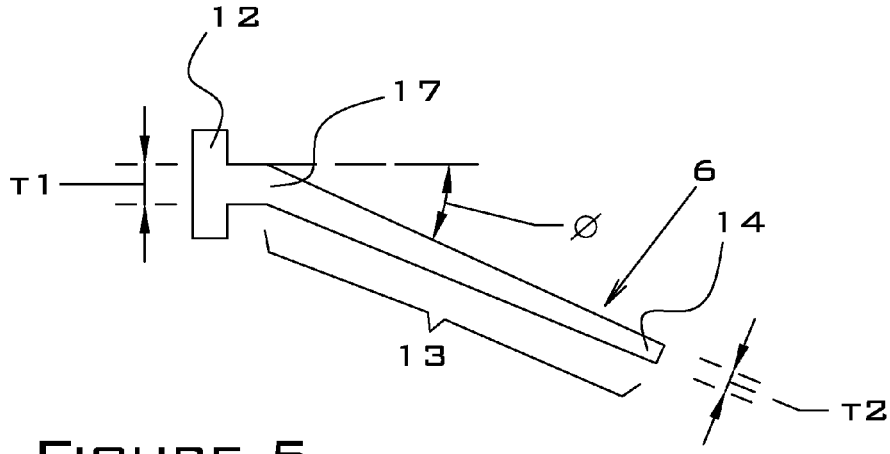
FIGURE 5

FIGURE 7
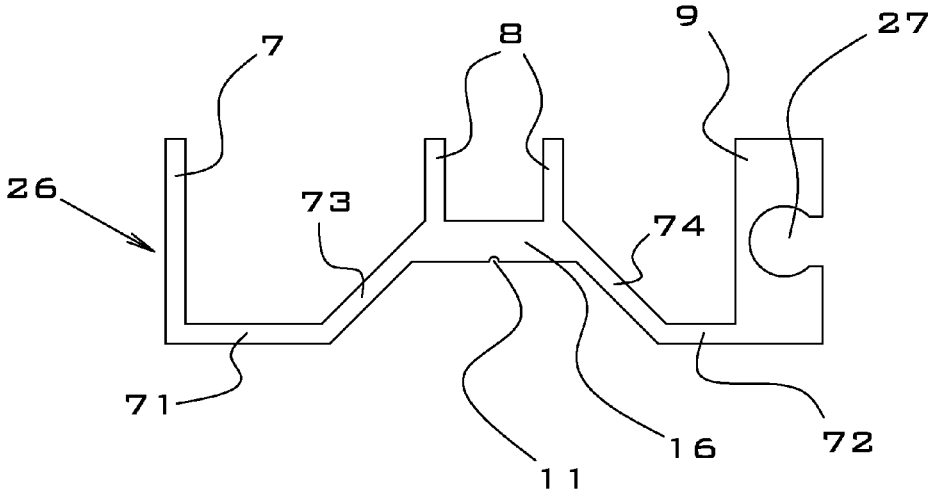
FIGURE 8A
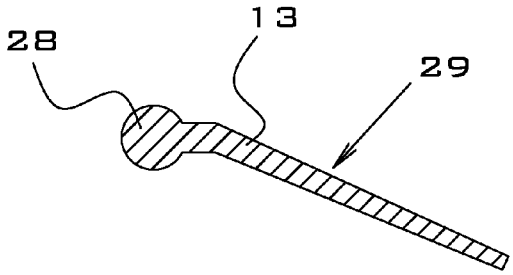
FIGURE 8C
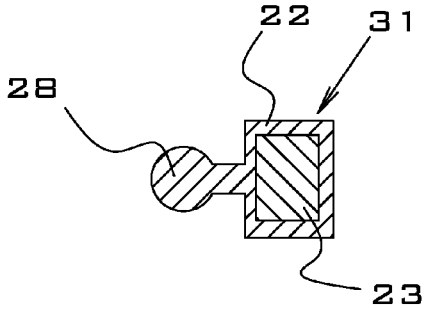
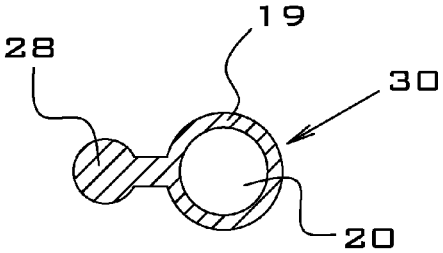
FIGURE 8B
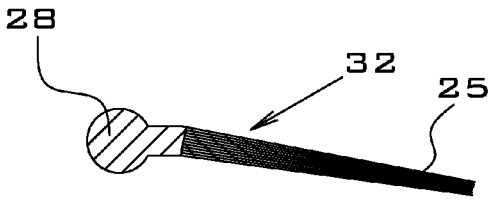
FIGURE 8D

WEATHERGUARD DOOR SEALING DEVICE WITH REPLACEABLE SEAL

BACKGROUND OF THE INVENTION

1. Field of the Invention

The present invention relates to the field of door sealing devices, and more particularly, to a frame-mounted sealing assembly used to weatherproof overhead garage doors, hinged entry doors, freezer doors, and roll-up doors.

The present invention also relates to the field of window frames, and more particularly, to window frames suitable for use on structures such as houses, greenhouses, sheds, etc.

2. Description of the Related Art

There are a number of door sealing devices that are the subject of issued patents or pending applications and also multiple examples of commercially available door sealing devices, but none of these inventions or products includes the novel features of the present invention. The present invention is comprised of a metal main frame and a flexible sealing component. The main frame has a unique shape with internal reinforcement braces that make it particularly rigid and durable compared to the prior art. It resists deformation due to compressive forces from the attachment fasteners and also resists buckling due to external loads. It also incorporates a longitudinal groove that serves as a drill-hole positioning guide. Unlike the prior art, the main frame can be used with a variety of different and interchangeable sealing elements for various applications.

The present invention comprises four alternate sealing elements, including a flexile polymer fin having an angled shape that improves sealing and durability, a hollow bulb seal, a magnetic seal, and a brush seal. Each of these sealing elements may be replaced without removing the main frame from the structure to which it is mounted.

U.S. patent application Ser. No. 10/822,399 (Stutzman et al., 2005), now abandoned, discloses a garage door bottom seal designed to be attached to the bottom edge of a garage door. The device is comprised of a flexible compression-type seal and a rigid flat base. In a preferred embodiment, the base and flexible seal are both comprised of polymer materials that are coextruded as a single unit. Unlike the present invention, the Stutzman invention does not comprise a reinforced metal main frame or replaceable, angled fin sealing element.

U.S. Pat. No. 6,772,551 (Berger, Jr., 2004) discloses a garage door trim assembly with a removable sealing element. Like the present invention, this device is designed to be mounted on the side frames of a garage door assembly and is comprised of a base unit and a replaceable flexible seal. The base of the Berger device is roll-formed from sheet material and lacks the reinforcing legs and thick outer walls of the present main frame. The sealing member of the Berger invention lacks the angled shape and tapered cross section of the sealing member of the present invention. The connection between the base and sealing member of the Berger invention is accomplished by a simple folded-in "bay" within the base that appears to provide a simple friction-fit connection between the base and sealing member, unlike the T-shaped or round receiver channels of the present invention that connect to the sealing elements with T-shaped or round ends that mate with the receiver channels.

U.S. Pat. No. 3,374,580 (Ruff, 1968) discloses a weather sealing strip designed to be used with side-opening sheet metal doors. The device may be used to seal the bottom and sides of a door but is specifically designed to be adjustable so that the bottom gap between the door bottom and the door frame sill may be sealed for doors of two standard heights.

The device is mounted to the edges of the door rather than the door frame. The device is comprised of a mounting rail and a flexible sealing strip. The mounting rail is formed from a solid metal bar, for example, extruded aluminum. The sealing strip is hollow and U-shaped in cross section and comprises multiple longitudinal fins along the outer edge to provide an improved seal. The sealing strip is attached to the mounting rail via a T-shaped channel within the mounting rail that mates with T-shaped edges of the sealing strip. Unlike the present invention, the base unit of the Ruff invention must be detached from its supporting structure in order to replace the sealing strip.

U.S. Pat. No. 3,324,598 (Tinflow et al., 1967) discloses a door bottom weather strip that attaches to the bottom edge of a door. The device comprises a two-piece metal base and a flexible vinyl seal and is specifically designed to accommodate doors of two different thicknesses. The sealing strip is attached to the mounting rail via a T-shaped channel within the mounting base that mates with T-shaped edges of the sealing strip, in a manner similar to the present invention, but the structures of the base unit and sealing elements are different from the present invention.

U.S. Pat. No. 2,949,651 (Hill, 1960) discloses a door bottom weather stripping device comprised of a preferably metal base and flexible, replaceable seal. The devices attaches to the bottom edge of a door. The seal is attached to the base by a pair of round channels manufactured into the base that mate with round heads at the two longitudinal edges of the seal. The round mating connection is designed to provide rotational movement between the seal and base, thereby reducing failures due to flexing of the seal. The seal comprises a series of fins along the outer edge to provide an improved seal with the door frame. The base unit of the Hill invention differs from the present base unit in that it does not comprise reinforcing legs and is not designed to have sufficient strength to serve as structural support.

U.S. Pat. No. 4,497,136 (Khallil, 1985) discloses a spring-loaded weather strip that mounts on a door frame and provides a self-adjusting seal between is warped door and its frame. The device comprises a two-piece aluminum base and a poly-pile sealing strip. The sealing strip is pressed against the door via curved steel bar springs located within the base component of the device. The base component of the Khallil invention differs from the present base unit in that it is comprised of multiple pieces that move relative to each other, whereas the base (main frame) of the present invention is a comprised of a single piece of extruded metal with reinforcing legs.

U.S. Pat. No. 2,612,664 (Sidden, 1952) discloses a weather stripping device for storm doors. The device may be attached either to the door or to the door frame, depending on the particular type of door to be treated. The device is comprised of a metal base component and a flexible rubber sealing strip. The sealing strip is attached to the base by folding the metal base around one edge of the strip. The shape of the fold is designed to result in the strip having an angle of about 45 degrees relative to the face of the base. The free edge of the sealing strip is tapered to a knife edge. Unlike the present invention, the sealing strip of the Sidden invention is not replaceable, nor does it comprise a bend manufactured into the flexible component.

In addition to the prior-art patents and applications described above, there are several commercially available products that have some superficial similarity to the present invention, but all of these have significant structural differences from the present invention. One example of a commercially available product is the "Aluminum and Vinyl Garage Door Bottom, #87643" sold by Home Depot (homedepot-.com) of Atlanta, Ga. This product is a composite material comprised of an aluminum base and a non-removable, semi-circular vinyl sealing strip. The product is designed to be attached to the bottom edge of a garage door with screws.

A second example of a commercially available product is the "Aluminum & Santoprene Weather Strip, #N7225" sold by Its Easy Being Green (itseasybeinggreen.com) of Cedar Knolls, N.J. This product is comprised of an extruded aluminum base plate and a round, hollow SANTOPRENE® sealing strip. The connection between the base and sealing strip is via a T-shaped channel extruded into the aluminum base that encloses a mating T-shaped end on the sealing strip. The base of this product differs from the present base in that it is flat and lacks reinforcing legs.

A third example of a commercially available product is the "Thermwell VA17WH Frost King 17 Foot Aluminum Plus Tubular Vinyl Strip Door Set" sold by Hardware and Tolls.Com (hardwareandtools.com) of Winchester, Va. This product is comprised of an extruded aluminum base plate and a hollow tubular vinyl sealing strip. The two components are attached via a round extruded channel in the base that mates with a round end on the sealing strip. The base of this product differs from the present invention in that it lacks reinforcing legs.

A fourth example of a commercially available product is the "M-D Building Products Silver Aluminum with Vinyl Door Weather Strip, #297193) sold by Lowes (lowes.com) Mooresville, N.C. This product is a replacement threshold seal designed to be attached to the bottom frame of a door. It is a composite material comprised of an aluminum base with a vinyl insert seal. The structure of this product differs from the present invention in that the sealing element for this product is attached to the top of the base over the fastening screws, whereas in the present invention, the sealing element is attached to one edge of the base. The sealing element of this product does not appear to be replaceable.

A fifth commercially available product is the "Aluminum weather strip seal, #815715) sold by TradeKD (tradekd.com). This product is comprises of an extruded aluminum base with a flexible sealing strip attached to one edge of the base via a rectangular channel. This product differs from the present invention in that the base does not have reinforcing legs, and the sealing element does not have a manufactured bend.

A sixth example of a commercially available product is the "Q-Lon Door Kit with Aluminum Carrier, #10130.1" sold by ConservationMart (conservationmart.com). This product is designed to attach to the sides and top of door frames with screws and is comprised of a galvanized aluminum base and a polyethylene-clad urethane foam sealing strip. The sealing strip is attached to the base via a rectangular channel manufactured into one end of the base. This product differs from the present invention in that the base does not have reinforcing legs, and the sealing element is comprised of polymer foam rather than flexible polymer.

BRIEF SUMMARY OF THE INVENTION

The present invention is a weatherguard door sealing device comprising a single piece of metal, wherein the single piece of metal comprises an outer leg, a receiving leg, a center section, a first planar surface, a second planar surface, a first diagonal surface, a second diagonal surface, and two inner reinforcing legs; wherein the first planar surface connects the outer leg to the first diagonal surface, the first diagonal surface connects the center section to the first planar surface, the second planar surface connects the receiver leg to the second diagonal surface, and the second diagonal surface connects the center section to the second planar surface; wherein the receiver leg comprises a receiver channel for receiving a sealing element; wherein the two inner reinforcing legs are parallel to each other and extend perpendicularly from the center section; and wherein each of the first and second planar surfaces, the first and second diagonal surfaces, and the center section has a thickness, and the thickness of the center section is greater than the thickness of the first and second planar surfaces and the first and second diagonal surfaces.

In a preferred embodiment, the receiver channel is T-shaped in cross-section. Preferably, the sealing element has a T-shaped proximal end, a distal end, and a blade section having a base, the base of the blade section has a thickness, the distal end of the sealing element has a thickness, and the thickness of the base of the blade section is greater than the thickness of the distal end of the sealing element. The base of the blade section preferably comprises a bend having an angle of roughly twenty-five degrees.

In an alternate embodiment, the sealing element is a hollow-bulb sealing element having a T-shaped proximal end, a rubber bulb member, and an air-filled core. In another alternate embodiment, the sealing element is a brush-type sealing element with a T-shaped proximal end and brush fibers. In yet another alternate embodiment, the sealing element is a magnetic sealing element with a T-shaped proximal end, a rectangular polymer member, and a magnetic core encapsulated within the rectangular polymer member.

In a preferred embodiment, the receiver channel is round in cross-section. Preferably, the sealing element has a proximal end that is round in cross-section, a distal end, and a blade section having a base, the base of the blade section has a thickness, the distal end of the sealing element has a thickness, and the thickness of the base of the blade section is greater than the thickness of the distal end of the sealing element. The base of the blade section preferably comprises a bend having an angle of roughly twenty-five degrees.

In an alternate embodiment, the sealing element is a hollow-bulb sealing element having a proximal end that is round in cross-section, a rubber bulb member, and an air-filled core. In another alternate embodiment, the sealing element is a brush-type sealing element with a proximal end that is round in cross-section and brush fibers. In yet another alternate embodiment, the sealing element is a magnetic sealing element with a proximal end that is round in cross-section, a rectangular polymer member, and a magnetic core encapsulated within the rectangular polymer member.

In a preferred embodiment, the center section comprises a longitudinal drilling guide groove. The invention is also a window frame comprising one or more of the weatherguard door sealing device described above.

BRIEF DESCRIPTION OF THE DRAWINGS

FIG. 4 is a top view of the main frame of the present invention comprising a rectangular receiver channel.

FIG. 5 is a top view of the sealing element of the first embodiment of the present invention.

FIG. 7 is a top view of the main frame of the present invention comprising a round receiver channel.

FIGS. 8A-8D are transverse cross-section views of the fifth through eighth embodiments of the invention.

REFERENCE NUMBERS

Figure 1:
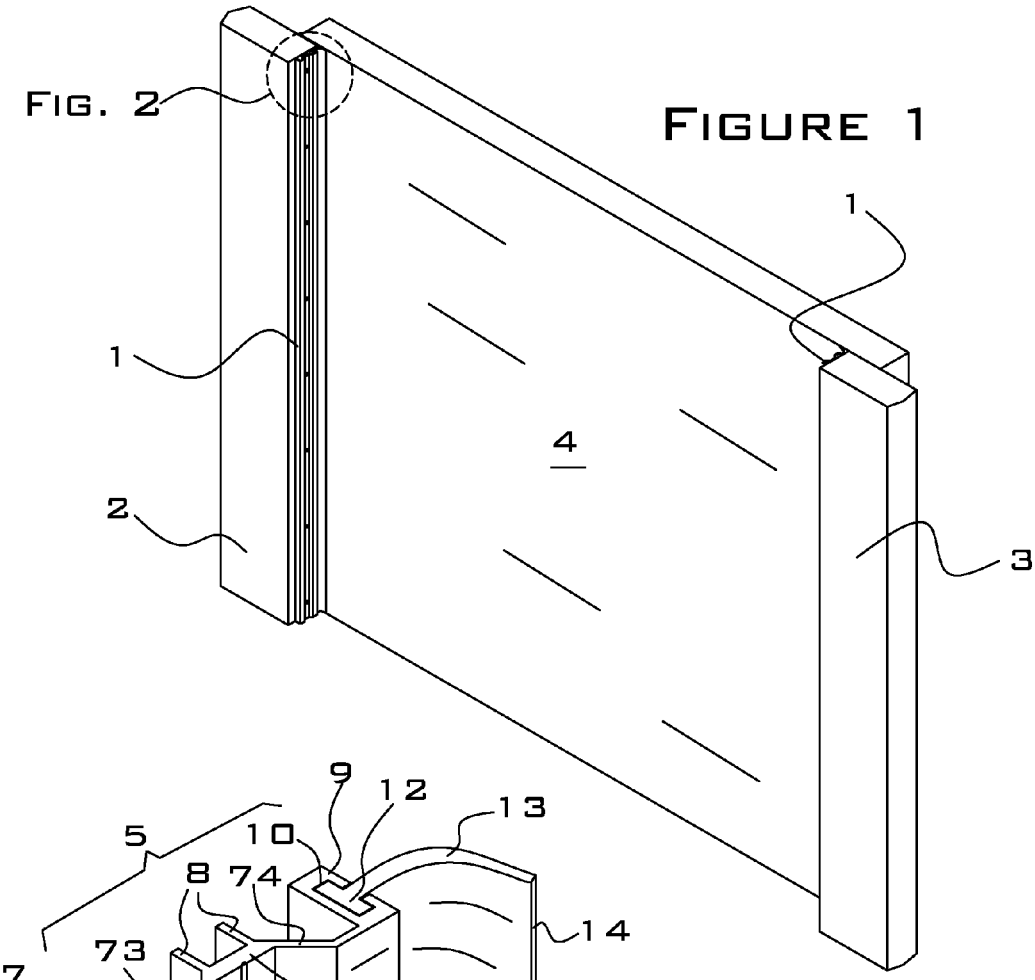
FIG. 1 is an isometric view of the first embodiment of the present invention attached to the left and right door frames of a sliding garage door.

1 Weatherproof door sealing device, first embodiment
2 Left door frame
3 Right door frame
4 Sliding garage door
5 Main frame with T-shaped receiver channel
6 Blade-type sealing element with T-shaped proximal end
7 Outer leg
8 Reinforcing leg
9 Receiver leg
10 T-shaped receiver channel
11 Drilling guide groove
12 T-shaped proximal end
13 Blade section
14 Distal end
15 Fastening screw
16 Center section of main frame
17 Base of blade section
18 Hollow-bulb sealing element with T-shaped proximal end
19 Rubber bulb member
20 Air-filled core
21 Magnetic sealing element with T-shaped proximal end
22 Rectangular polymer member
23 Magnetic core
24 Brush-type sealing element with T-shaped proximal end
25 Brush fibers
26 Main frame with round receiver channel
27 Round receiver channel
28 Round proximal end
29 Blade-type sealing element with round proximal end
30 Hollow-bulb sealing element with round proximal end
31 Magnetic sealing element with round proximal end
32 Brush-type sealing element with round proximal end
33 Door frame
34 Hex-head screw
35 Straight drill hole
36 Head of hex-head screw
37 V-shaped segment of main frame
38 Countersunk flathead screw
39 Hole with tapered countersink section
40 Head of flathead screw
41 Left piece of door sealing device
42 Top piece of door sealing device
43 Miter joint
44 Window frame with single pane and no central support member
45 Left side of window frame, single pane
46 Right side of window frame, single pane
47 Top side of window frame, single pane
48 Bottom side of window frame, single pane
49 Building walls
50 Window opening
51 Outer window pane
52 Adhesive sealant
53 Window frame with single pane and central support member
54 Auxiliary support frame member
55 Left pane, single thickness
56 Right pane, single thickness
57 Window frame with a double pane and no central support member
58 Left side of window frame, double pane
59 Right side of window frame, double pane
60 Top side of window frame, double pane
61 Bottom side of window frame, double pane
62 Outer window pane
63 Inner window pane
64 Air gap
65 Window frame with double pane and double-pane support member
66 Double-pane internal support member
67 Outer left pane
68 Outer right pane
69 Inner left pane
70 Inner right pane
71 First planar surface
72 Second planar surface
73 First diagonal surface
74 Second diagonal surface

DETAILED DESCRIPTION OF INVENTION

The present invention is a device that provides a weatherproof seal around the edges of various types of doors. It is designed to be more durable and efficient than other currently available products. The invention may be installed during new construction or as a replacement for inferior weatherproofing on existing doors. The invention comprises heavy-duty extruded aluminum main frame and a readily replaceable sealing strip that is removably attached to the main frame. Various types of sealing strips may be attached to the main frame to optimize the invention for specific applications, as described for preferred embodiments below.

There are eight preferred embodiments of window seal for the present invention. In all of these embodiments, the sealing components are attached to the main frame via a channel in the main frame that mates with a protrusion on the proximal end of the sealing component. The mating connections may be either T-shaped or round. The first four embodiments of the present invention comprise a T-shaped connection, and the last four embodiments comprise a round connection.

In a first preferred embodiment of the invention, an angled fin-shaped sealing strip is employed to provide sealing along the sides and top of a vertically-moveable door such as a garage door, warehouse door, service door, or other similar door. In a second preferred embodiment of the invention, a rubber bulb seal is used to seal around the edges of a conventional hinged-type entry door. In a third preferred embodiment, a magnetic compression seal is used for sealing a walk-in freezer door, cooler door, or other similar door. In a fourth preferred embodiment, a brush seal is used for sealing around a roll-up overhead door or similar door. The sealing elements for embodiments five through eight are similar to the sealing elements of embodiments one through four, except that the proximal ends are round in cross section rather than T-shaped.

In addition to the door sealing applications described tor the first through eighth preferred embodiments, the main frame component of the invention may be used without a sealing component as a structural framework for window frames. Preferred embodiments nine through twelve are related to window frame devices. In all of the window frame embodiments, the edges of the window panes are inserted into T-shaped receiver channels of the frame pieces and sealed with adhesive sealant.

In a ninth preferred embodiment of the present invention, four lengths of main frame are joined to form a rectangular, single-pane window frame. The tenth embodiment is a window frame that comprises a center support and two single-thickness panes. The eleventh embodiment is a window frame that comprises a dual pane with no center support, and the twelfth embodiment is a window frame that comprises a dual pane with center support.

The construction and operation of the present invention is described more fully below in reference to FIGS. 1 through 20.

FIG. 1 is an isometric view of the first embodiment of the present invention, which is weatherproof door sealing device 1, attached to a left door frame 2 and a right door frame 3 of a sliding garage door 4. The present invention may be used to seal the top edge, as well as the side edges, of a garage door. The sealing installation is described in reference to FIG. 11.

Figure 2:
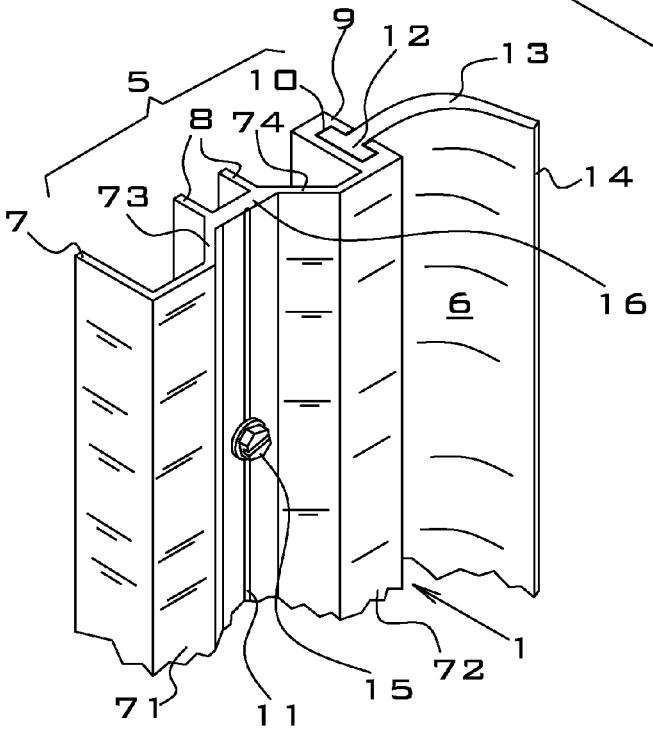
FIG. 2 is an isometric view of a partial section of the present invention used to seal the left side of a garage door as shown in FIG. 1.

FIG. 2 is an isometric view of a partial section of the first embodiment of the door sealing device 1 as shown in FIG. 1. Major components of the door sealing device 1 consist of a main frame 5 and a sealing element 6. The main frame 5 comprises an outer leg 7, two inner reinforcing legs 8, a receiver leg 9, a T-shaped receiver channel 10, and a drilling guide groove 11. The sealing elements 6 comprises a T-shaped proximal end 12, a blade section 13, and a distal end 14. Also shown is a fastening screw 15, which is used to attach the door sealing device 1 to a door frame (shown in FIG. 1). The sealing element 6 is shown in a deflected or curved shape, as will occur when it is pressed against a garage door (as shown in FIG. 1). The legs 7, 8, 9 provide reinforcement against warping and buckling of the main frame 5 from external loads such as wind loads and accidental contact, similar to the webs of structural I-beams. In addition, the two inner reinforcing legs 8 serve to prevent warping of the main frame 5 due to over-tightening of the fastening screws 15. The function of the reinforcing legs is described in detail with reference to FIG. 9.

Note that the main frame 5 also comprises two planar surfaces 71, 72 and two diagonal surfaces 73, 74 that connect the various other components of the main frame 5 identified above. Specifically, the first planar surface 71 connects the outer leg 7 to the first diagonal surface 73, which connects the center section 16 to the first planar surface 71. The second planar surface 72 connects the receiver leg 9 to the second diagonal surface 74, which connects the center section 16 to the second planar surface 72.

The main frame 5 is preferably comprised of extruded aluminum and is powder-coated to prevent corrosion. The sealing element 6 is preferably comprised of extruded thermoplastic vulcanate (TPV) or similar polymer having a useful flexibility over a wide temperature range. SANTOPRENE® polymer manufactured by Exxon Chemical Corporation (http://www.exxonmobilchemical.com) is one example of a polymer that works well for this component.

Figure 3:
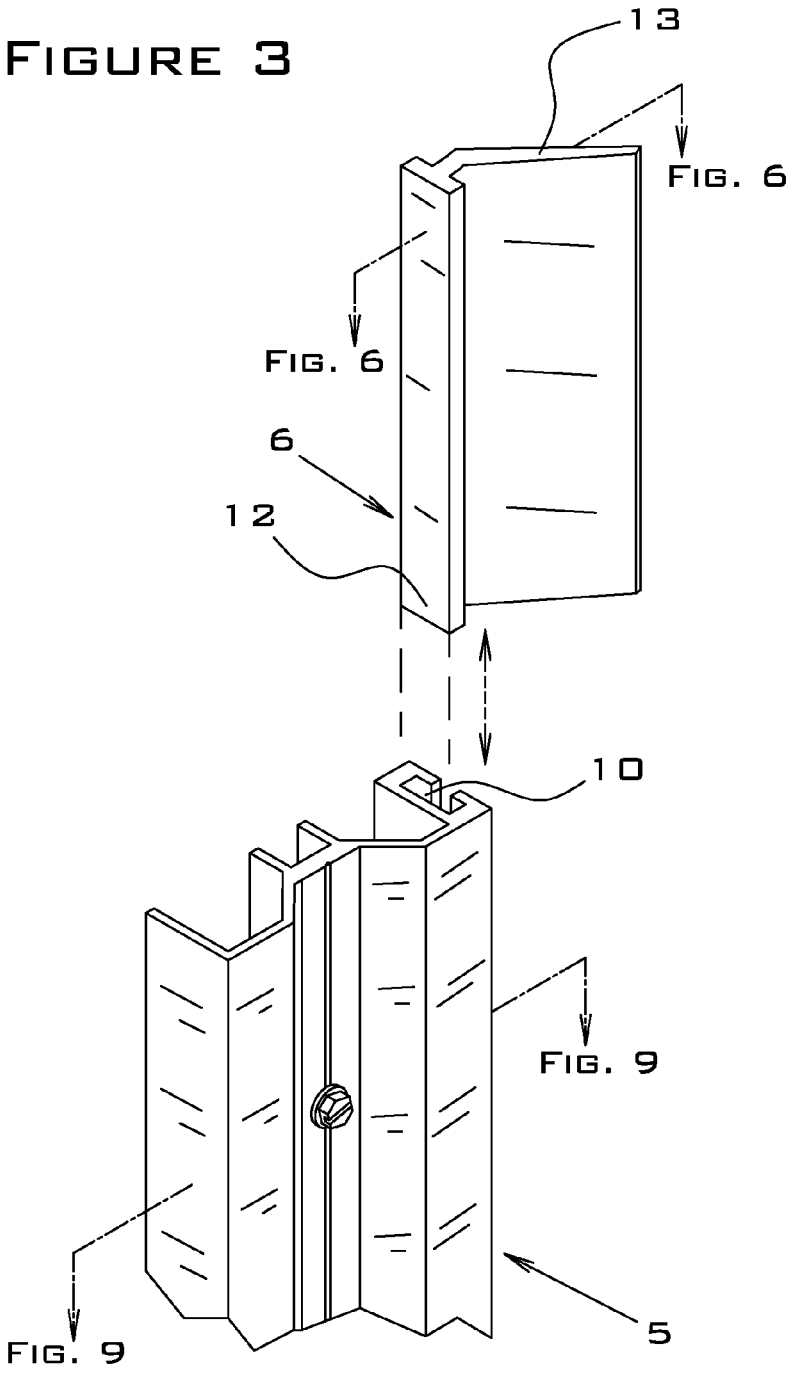
FIG. 3 is an isometric view of a section of the first embodiment of the present invention with the sealing strip separated from the main frame, illustrating the method by which the sealing element is inserted into the main frame.
Figure 6A:
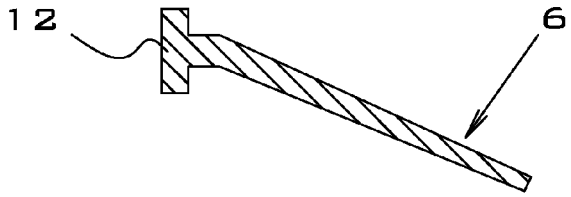
FIGS. 6A-6D are transverse cross-section views of the sealing elements of the first through fourth embodiments of the present invention.
Figure 6B:
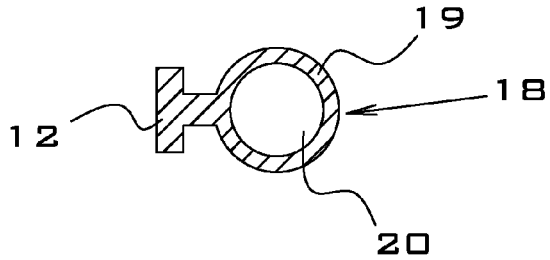
Figure 6C:
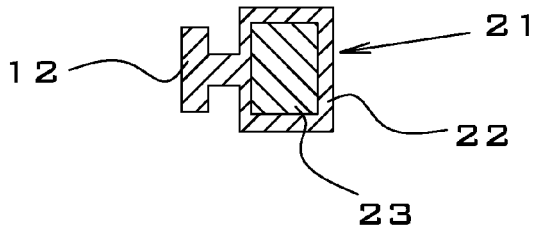
Figure 6D:
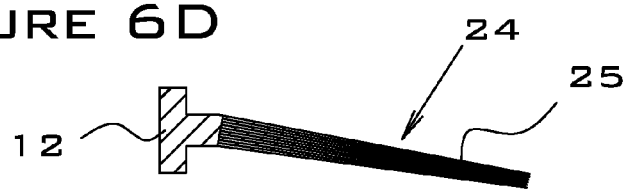

FIG. 3 is an isometric view of a section of the first embodiment of the present invention shown in FIG. 2, but shown with the sealing element 6 separated from the main frame 5, thereby illustrating the method by which the sealing element 6 is inserted into or removed from the main frame 5 by sliding the T-shaped proximal end 12 of the sealing element 6 into the mating T-shaped receiver channel 10 of the main frame 5. In FIG. 3, the blade section 13 of the sealing element 6 is shown in a non-deflected or non-curved shape, as will be the case when the sealing element 6 is not pressed into contact with a garage door.

FIG. 4 is a top view of the main frame 5 comprising a T-shaped receiver channel 10. As previously described, this type of main frame is used with the first through fourth preferred embodiments. Shown in FIG. 4 are the outer leg 7, the two inner reinforcing legs 8, the receiver leg 9, the drilling guide groove 11, and a center section 16. As shown, the wall thickness of the center section 16 is greater than the wall thickness of the legs 7, 8, 9. This additional wall thickness of the center section 16 allows sufficient thickness for a countersink hole to be drilled into the center section 16 for installation of a countersunk screw, if desired, as described in detail in reference to FIG. 10. Typical wall thickness values for the main frame 5 are about 0.06 inch for the legs 7, 8, 9 and 0.125 inch for the center section 16.

FIG. 5 is a top view of the sealing element 6 of the first embodiment of the present invention showing a base 17 of the blade section 13 that is adjacent to the proximal end 12 of the sealing element 6. As shown, the base 17 of the blade section 13 has a thickness of T1, and the distal end 14 of the blade section 13 has a thickness of T2, with T2 being less than T1. The base 17 also comprises a bend having an angle θ. This design, which provides for a blade section having a tapered thickness in combination with a pre-bent shape, minimizes stresses in the flexible material of the scaling element 11 at the zone of maximum bending stress (e.g., the base of the blade section) to provide excellent durability. It also provides adequate flexibility along the sealing surface (the distal end 14) to afford maximum sealing efficiency when the sealing element 6 is pressed against a door. A thickness of 0.127 inch for T1 and a thickness of 0.0625 inch for T2, in combination with an angle of about 25 degrees for angle θ, have proven to be effective for this design.

Reducing the bending stresses in the sealing element by incorporating a manufactured bend is a significant feature of the present invention that significantly improves blade life compared to the prior art. Although there are examples in the prior art of flexible blade-type seals with tapered thickness at the tip (for example, U.S. Pat. No. 2,612,664), there are no known instances in the prior art of a flexible blade-type seals that comprise a manufactured bend, or seals that comprise a combination of manufactured bend and tapered thickness along the length of the blade.

FIGS. 6A-6D are transverse cross-section views of the sealing elements of the first through fourth embodiments of the present invention. All of the sealing elements in these figures comprise proximal ends 12 that are T-shaped in cross section and that mate with the T-shaped receiver channel 10 of the main frame 5 shown in FIG. 4.

The first embodiment comprises a blade-type sealing element 6 as described previously in reference to FIG. 5. The second embodiment comprises a hollow-bulb sealing element 18 that comprises a rubber bulb member 19 that is round in cross section with an air-filled core 20. This type of seal is particularly useful for doors that require a compression seal, such as entry doors and other similar hinged doors that swing to open and open and close. The third embodiment comprises a magnetic compression sealing element 21 that comprises a polymer channel 22 that is rectangular in cross section incorporating an encapsulated magnetic core 23. This type of seal is particularly useful for swinging doors that have metal frames and that require compression seals, such as entry doors for freezers and coolers. The fourth embodiment comprises a brush-type sealing element 24 that comprises a strip of polymer brush fibers 25. This type of seal is particularly useful for roll-up overhead doors and other sliding doors with corrugated or otherwise uneven sealing faces.

FIG. 7 is a top view of a main frame 26 of the present invention comprising a round receiver channel 27. Except for the shape of the receiver channel 27, the main frame 26 is identical to the main frame 5 described in reference to FIGS. 1-4. The round receiver channel 27 of the main frame 26 is designed to mate with replaceable and interchangeable sealing elements having round proximal ends that comprise preferred embodiments five through eight.

FIGS. 8A-8D are transverse cross-section views of the sealing elements of the fifth through eighth embodiments of the invention. All of the sealing elements shown in these figures have proximal ends 28 that are round in cross section. Except for their round proximal ends 28, the sealing elements of embodiments five through eight are identical to the sealing elements of embodiments one through four, respectively. The fifth embodiment comprises a blade-type sealing element 29 with a bent and tapered blade 13. The sixth embodiment comprises a hollow-bulb compression seal element 30 that comprises a round rubber bulb member 19 with an air-filled core 20. The seventh embodiment comprises a magnetic sealing element 31 that comprises a rectangular polymer member 22 with an encapsulated magnetic core 23. The eighth embodiment comprises a brush-type sealing element 32 that comprises polymer brush fibers 25.

Figure 9:
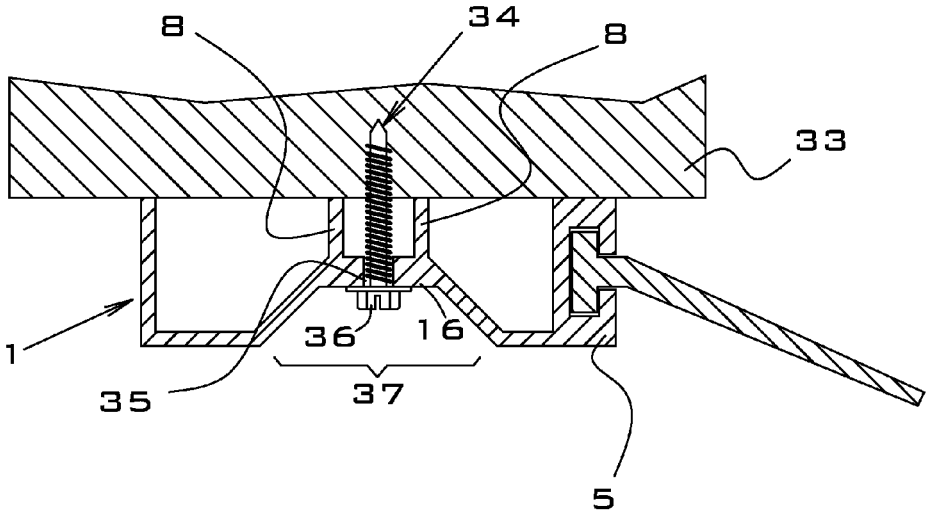
FIG. 9 is a transverse cross-section view of the present invention shown attached to a door frame with a hex-head screw.
Figure 10:
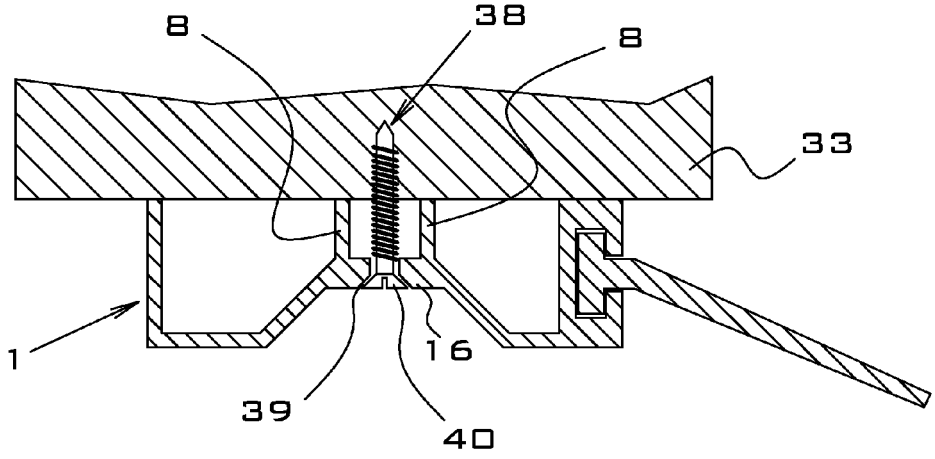
FIG. 10 is a transverse cross-section view of the present invention shown attached to a door frame with a countersunk flathead screw.

FIG. 9 and FIG. 10 illustrate two methods of attaching the present invention to a door frame with screws. Although these figures are shown with the first embodiment of the present invention 1, the fastening methods shown in FIGS. 9 and 10 are identical for all embodiments of the invention.

FIG. 9 is a cross-section transverse view of the door sealing device 1 shown attached to a door frame 33 with a hex-head screw 34. To mount the present invention on a door frame using this type of screw, the installer drills a simple straight hole 35 for each screw 34 along the length of the main frame 5, with each hole 35 centered within the guide groove 11 (shown in FIGS. 2 and 4). As shown, the head 36 of each hex-head screw 34 protrudes above the surface of the center section 16 around the drill hole 35, but the recessed V-shaped segment 37 of the main frame 5 provides some protection against foreign objects snagging on the screw head.

FIG. 9 also illustrates the purpose of the reinforcing legs 8. As the screw 34 is screwed into the door frame 33 during installation of the door sealing device 1, the reinforcing legs 8 eventually are pressed against the surface of the door frame 33 and come under compressive load. The compressive resistance of the reinforcing legs 8 prevents the screw 34 from being screwed too deep into the door frame and thereby prevents the main frame 5 from becoming warped or buckled due to over-tightening of the screw 34. This reinforced design of the main frame is notably stronger and superior to unreinforced designs of the prior art (for example, U.S. patent application Ser. No. 10/320,878).

FIG. 10 is a cross-section transverse view of the door sealing device 1 shown attached to a door frame 33 with a countersunk flathead screw 38. To mount the door sealing device 1 on a door frame using this type of screw, the installer drills a hole 39 having a tapered countersink segment for each countersunk screw 38 along the length of the main frame 5, with each hole 39 centered within the guide groove 11 (shown in FIGS. 2 and 4). As shown, the flat head 40 of each screw 38 is flush with the surface of the center section 16 around the drill hole 39, thereby preventing the screw head 40 from snagging on foreign objects.

Figure 11:
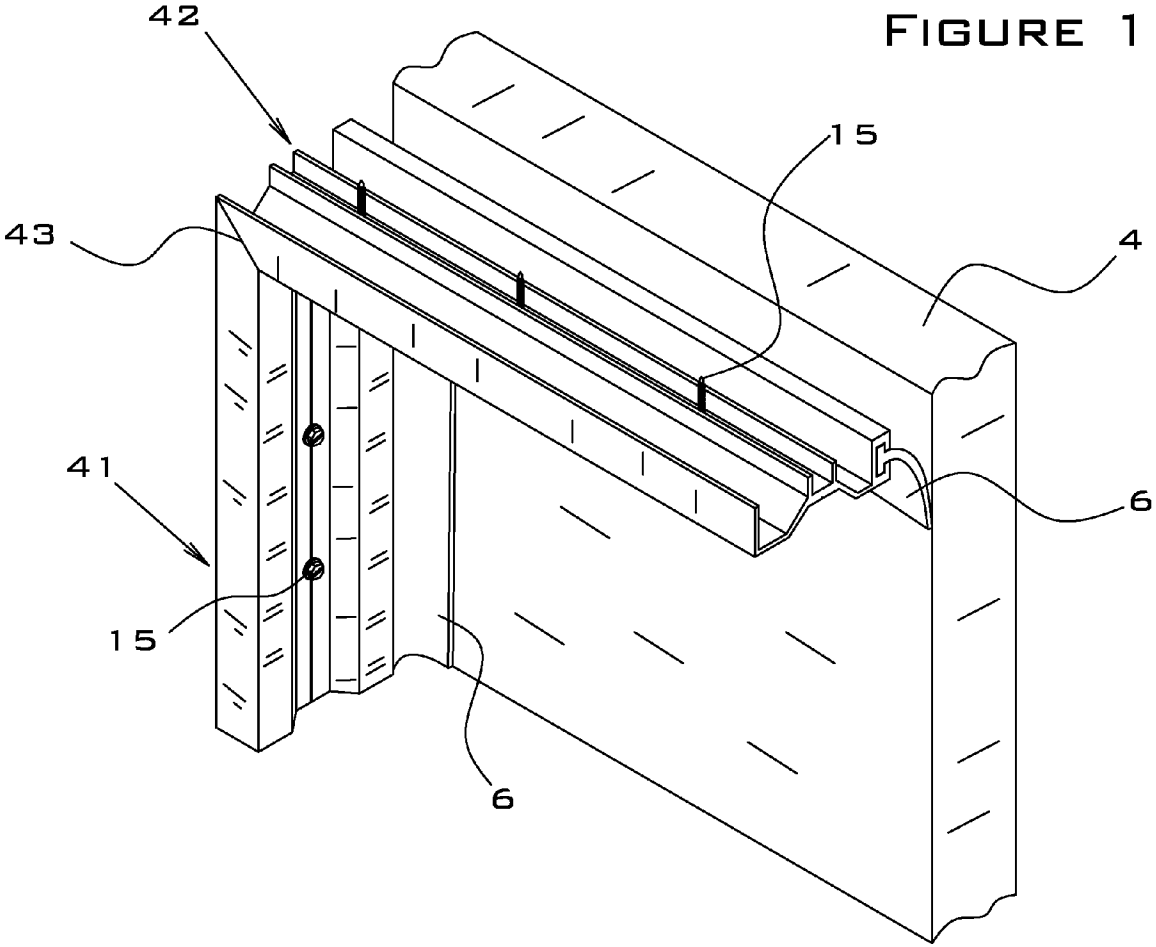
FIG. 11 is an isometric partial view of the present invention shown sealing the left side and the top side of a garage door.

FIG. 11 is an isometric partial view of the first embodiment of the present invention shown sealing the left side and the top side of a sliding garage door 4. The top door frame has been removed in FIG. 11 to show the detail of the top piece of the invention. This figure illustrates that the corner connection between left piece of the door sealing device 41 and the top piece of the door sealing device 42 is made by a miter joint 43 that is formed by making 45-degree cuts in the connecting edges of the two pieces 41, 42. Although a miter joint is normally preferable for aesthetic reasons, a square-cut joint (not shown) may also be used. Also shown in FIG. 11 are the preferred orientations of the sealing elements 6, which have their distal ends pointed toward the center of the door 4.

FIGS. 12-20 illustrate the present invention used as types of window frame devices. FIGS. 12-16 illustrate frames with single-thickness panes, and FIGS. 17-20 illustrate frames with double-thickness panes.

Figure 12:
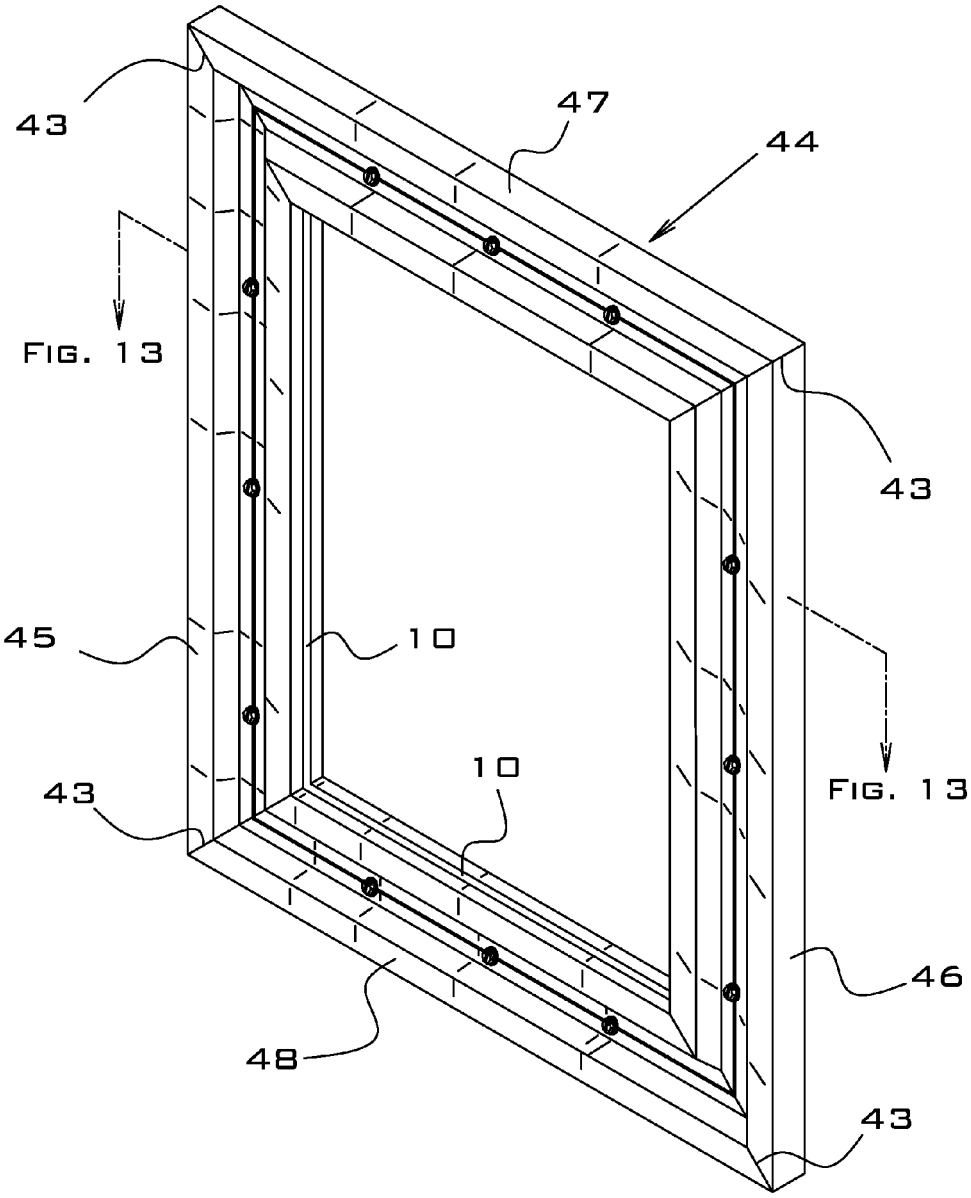
FIG. 12 is an isometric view of a rectangular window frame used to construct a window comprising a single window pane, shown with the pane removed for clarity.

FIG. 12 is an isometric view of a rectangular window frame 44 used to construct a window comprising a single window pane, shown with the pane removed for clarity. This type of window frame, which is the ninth embodiment of the present invention, is referred to as the "single pane, single sided" window frame. It is comprised of a left side 45, a right side 46, a top side 47, and a bottom side 48, where each of the sides 45-48 is comprised of a length of the main frame 5 shown in FIG. 7. Four miter joints 43 are used to connect the four sides of the frame. The T-shaped receiver channels 10 of the four sides 45-48 support the edges of a window pane, as shown in detail in FIG. 13.

Figure 13:
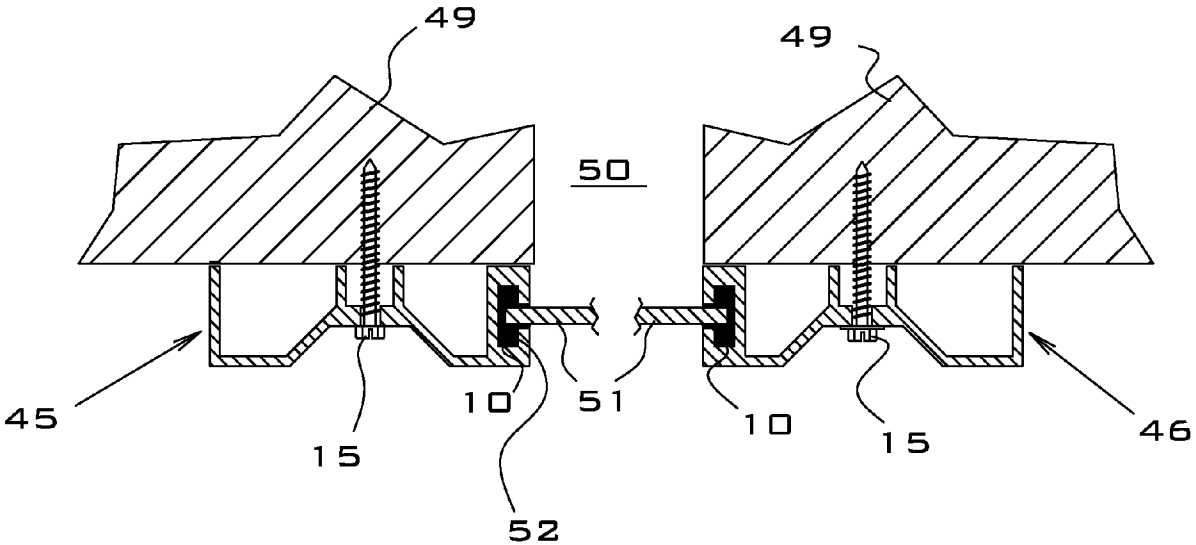
FIG. 13 is a transverse cross-section view of the ninth embodiment of the present invention, which is the window frame shown in FIG. 12, shown the left side and the right side mounted with fastening screws to building walls that surround a window opening.

FIG. 13 is a transverse cross-section view of the ninth embodiment of the present invention, which is the window frame shown in FIG. 12, shown with the left side 45 and the right side 46 mounted with fastening screws 15 to building walls 49 that surround a window opening 50. As shown, the side edges of a single window pane 51 are inserted into the T-shaped receiver channels 10 of the left and right side pieces 45, 46, and the pane 51 is sealed into the receiver channels 10 with adhesive sealant 52, which may be silicone sealant or other suitable sealant material. The top and bottom window sides, not shown, are constructed identically to the left and right sides shown. The resulting four-sided window frame 44 has sufficient structural strength to support the pane 51 in a rigid manner without additional structural support from the building walls 49. The window assembly, comprising the rectangular frame 44 and the pane 51, may be either prefabricated or installed in pieces on site.

Figure 14:
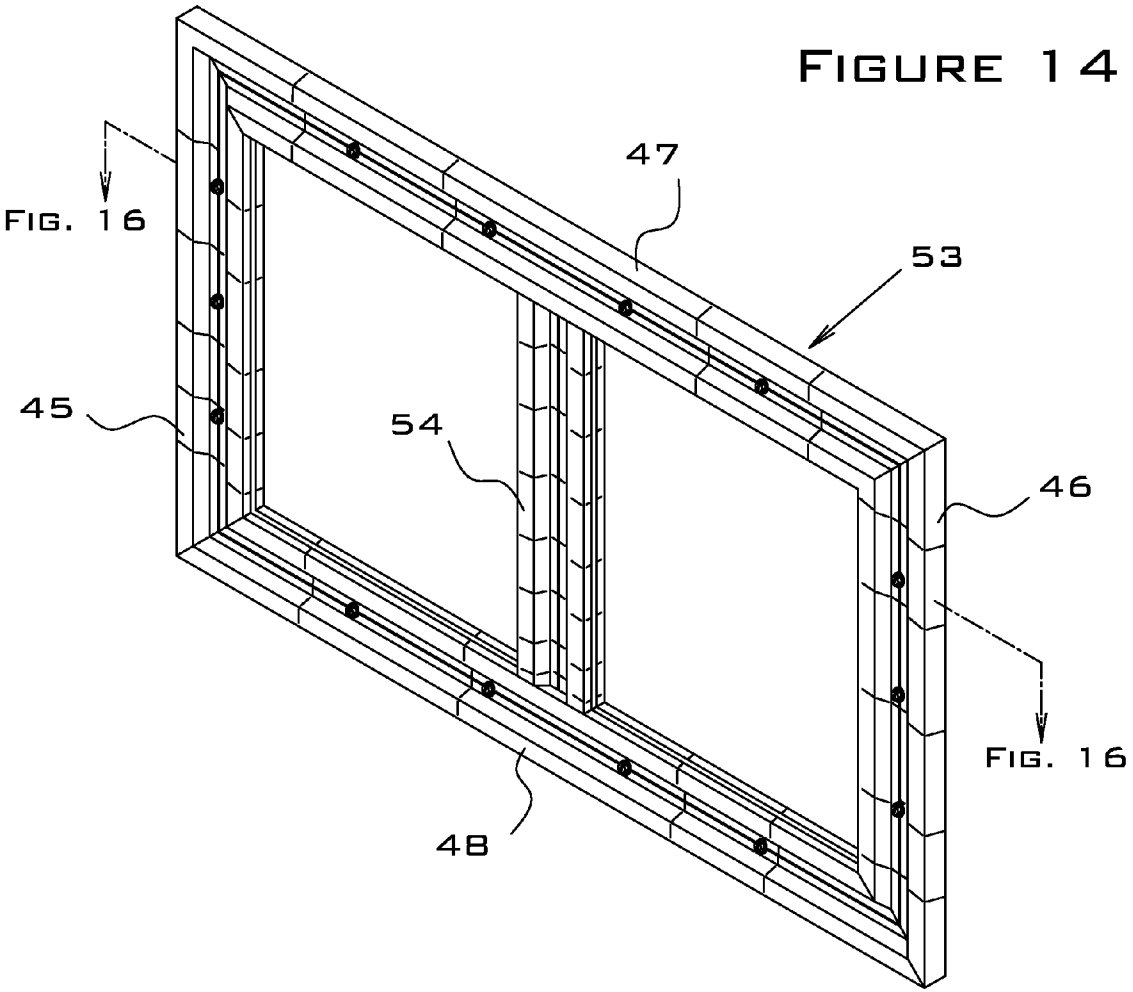
FIG. 14 is an isometric view of a window frame comprising a single thickness of window pane and a center structural frame support, with the window panes removed for clarity.

FIG. 14 is an isometric view of a window frame 53 comprising a single thickness of window pane and a center structural frame support, with the window panes removed for clarity. This type of window frame is the tenth embodiment of the present invention, which is referred to as the "single pane, double sided" window frame. It is similar to the embodiment shown in FIGS. 12 and 13, except it has an additional component, which is an auxiliary support frame member 54. The purpose of the auxiliary support frame member 54 is to provide additional rigidity to window frames that comprise relatively large window panes. The auxiliary support frame member 54 is shown in detail in FIG. 15.

Figure 15:
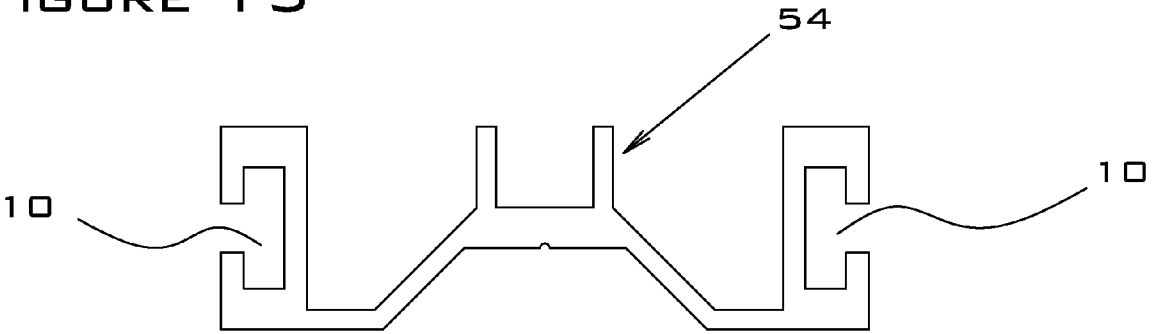
FIG. 15 is a top view of the auxiliary support frame.

FIG. 15 is a top view of the auxiliary support frame 54. This frame is similar to the main frame 5 shown in FIG. 7, except auxiliary support frame 54 comprises two T-shaped receiver channels 10 as shown, whereas the main frame 5 comprises a single receiver channel 10. The auxiliary support frame is preferably comprised of powder-coated, extruded aluminum.

Figure 16:
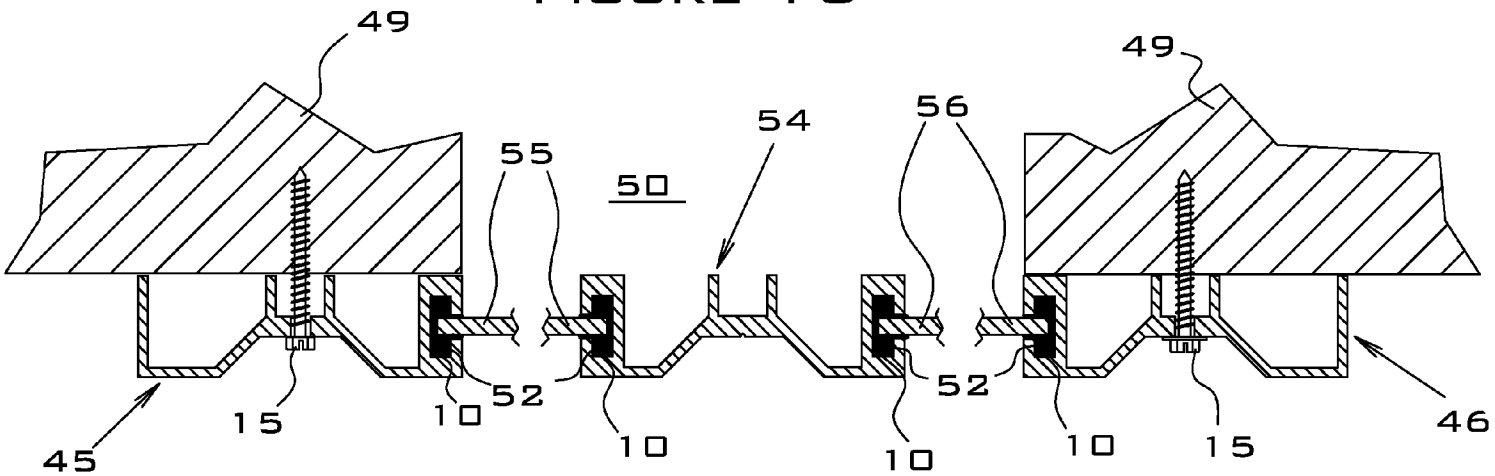
FIG. 16 is a transverse cross-section view of the tenth embodiment of the present invention, which is the window frame shown in FIG. 14, showing the left side, the right side, and the auxiliary support frame member.

FIG. 16 is a transverse cross-section view of the tenth embodiment of the present invention, which is the window frame shown in FIG. 14, showing the left side 45, the right side 46, and the auxiliary support frame member 54. This embodiment comprises a single thickness, two-piece pane, which is comprised of a left pane 55 and right pane 56, as shown. The edges of the window panes are installed within receiver channels 10 and sealed in place with adhesive sealant 52, as described previously in reference to FIG. 13. The frame is mounted to the building walls 49 adjacent to a window opening 50 using fastening screws 15, as previously described in reference to FIG. 13.

Figure 17:
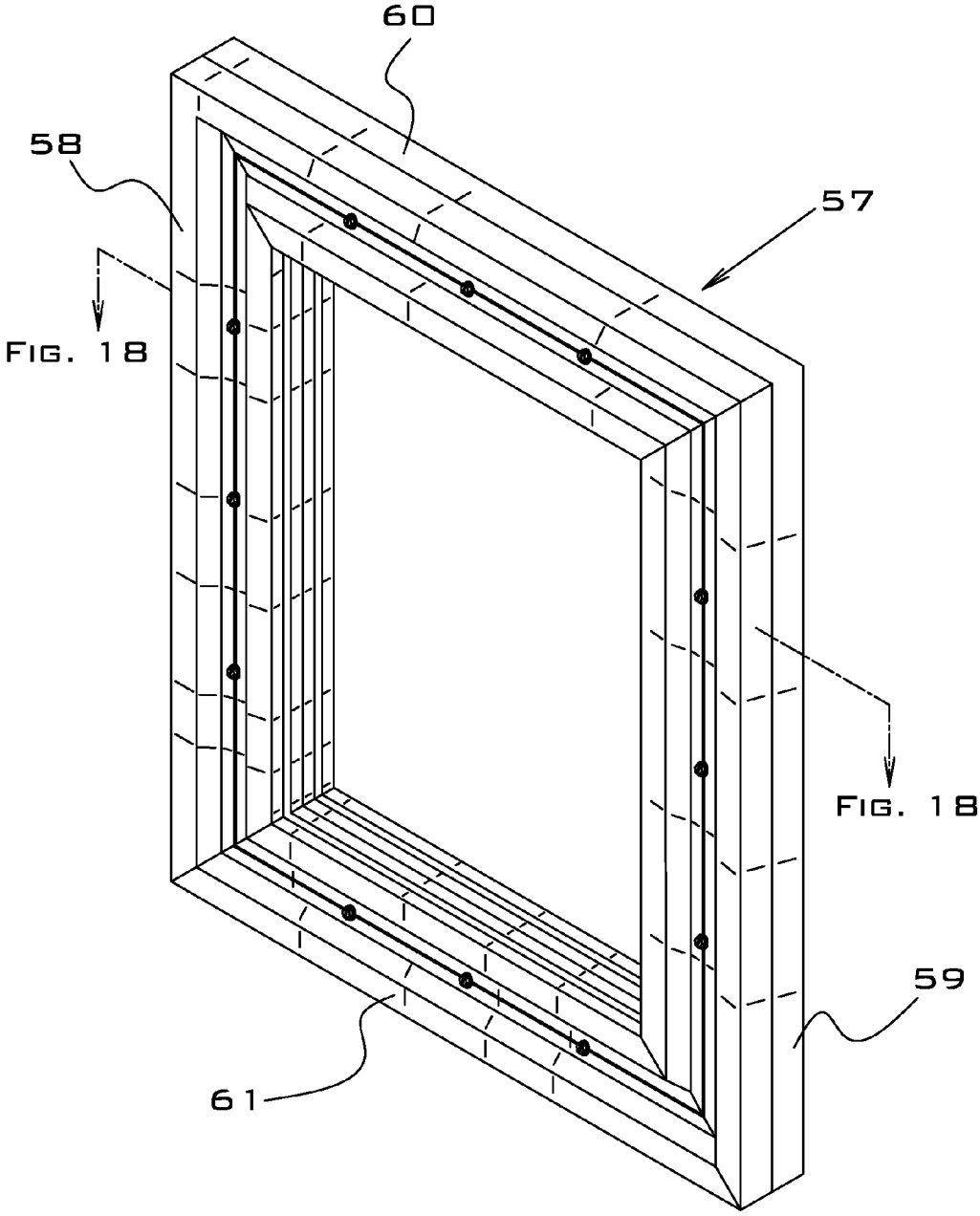
FIG. 17 is an isometric view of a window frame comprising a double-thickness window pane with no center structural frame support, shown with the window panes removed for clarity.

FIG. 17 is an isometric view of a window frame 57 comprising a double-thickness window pane with no center structural frame support, shown with the window panes removed for clarity. This type of window frame is the eleventh embodiment of the present invention, which is referred to as the "double pane, single sided" window frame. This embodiment comprises two of the single-pane, single sided units, as shown in FIGS. 12 and 13, which are connected back-to-back. The window frame 57 comprises a left side 58, a right side 59, a top side 60, and a bottom side 61. The details of the frame sides 58-61 are shown in FIG. 18.

Figure 18:
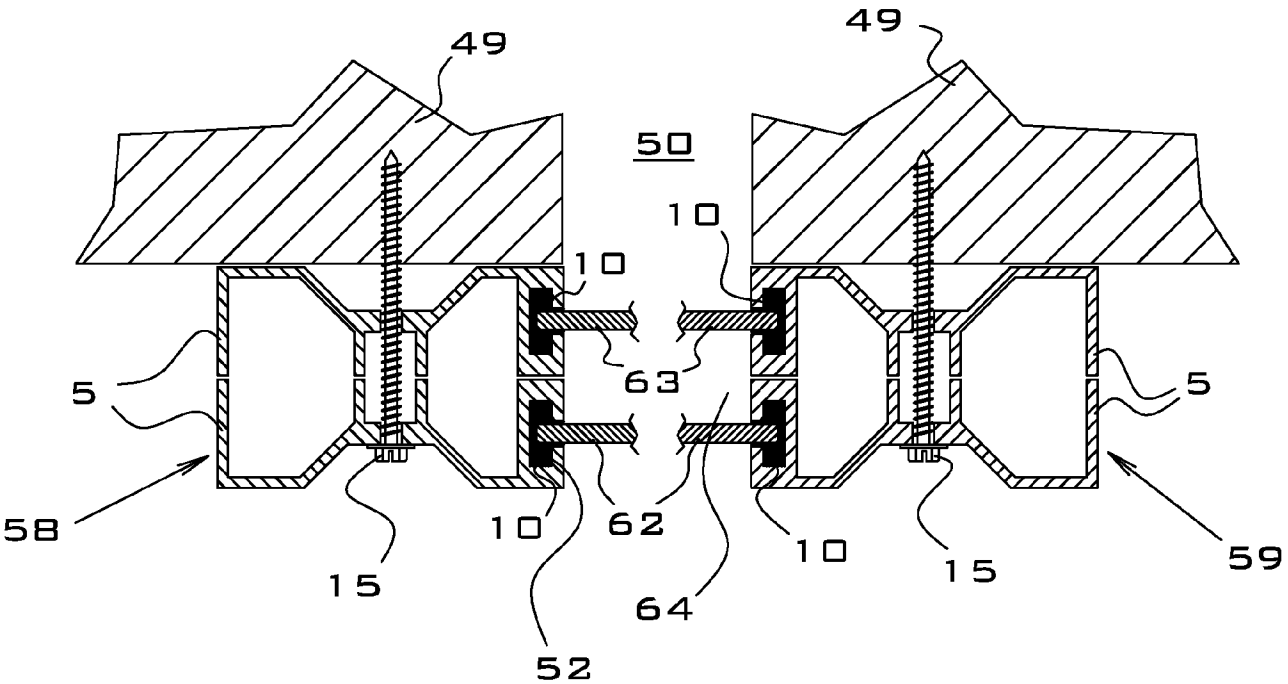
FIG. 18 is a transverse cross-section view of the eleventh embodiment of the present invention, which is the window frame shown in FIG. 17, showing the left side and the right side.

FIG. 18 is a transverse cross-section view of the eleventh embodiment of the present invention, which is the window frame shown in FIG. 17, showing the left side 58 and the right side 59. Two lengths of the main frame 5 with T-shaped receiver channels are used to form each side 58, 59 of the window frame in this double-paned window assembly. The two lengths of main frame 5 comprising each side 58, 59 are oriented back-to-back, so that each side 58, 59 comprises two receiver channels 10 oriented adjacent to each other as shown. The left side 58 and the right side 59 are oriented with respect to each other so that the T-shaped receiver channels 10 of the two sides 58, 59 are facing each other, and one pair of receiver channels 10 holds an outer pane 62, while the other pair of receiver channels holds an inner pane 63. The edges of the window panes are installed within receiver channels 10 and sealed in place with adhesive sealant 52, as described previously in reference to FIG. 13. The frame is mounted to the building walls 49 adjacent to a window opening 50 using fastening screws 15, as previously described in reference to FIG. 13. This double-pane configuration provides an insulating air gap 64 located between the panes 62, 63.

Figure 19:
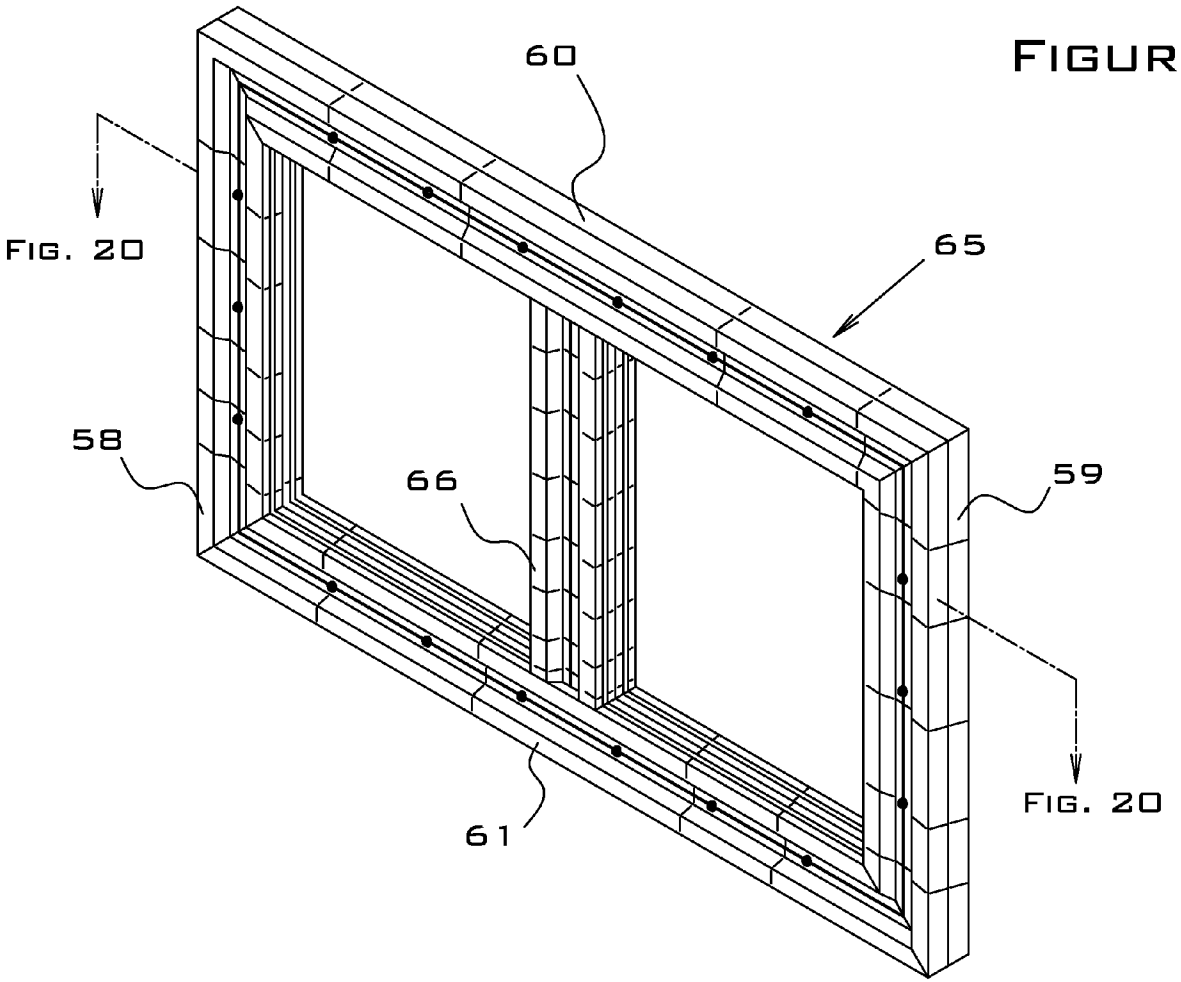
FIG. 19 is an isometric of a window frame comprising a double-pane frame with a double-pane internal support member, shown with the window panes removed for clarity.

FIG. 19 is an isometric view of a window frame 65 comprising a double-pane frame with a double-pane internal support member, shown with the window panes removed for clarity. This type of window frame is the twelfth embodiment of the present invention, which is referred to as the "double pane, double sided" window frame. Frame 65 comprises a left side 58, a right side 59, a top side 60, a bottom side 61, and a double-pane internal support member 66. This embodiment is similar to the double-paned, single sided window frame of the eleventh embodiment, except it comprises, in addition, double-pane internal support member 66. Details of the internal support configuration are shown in FIG. 20.

Figure 20:
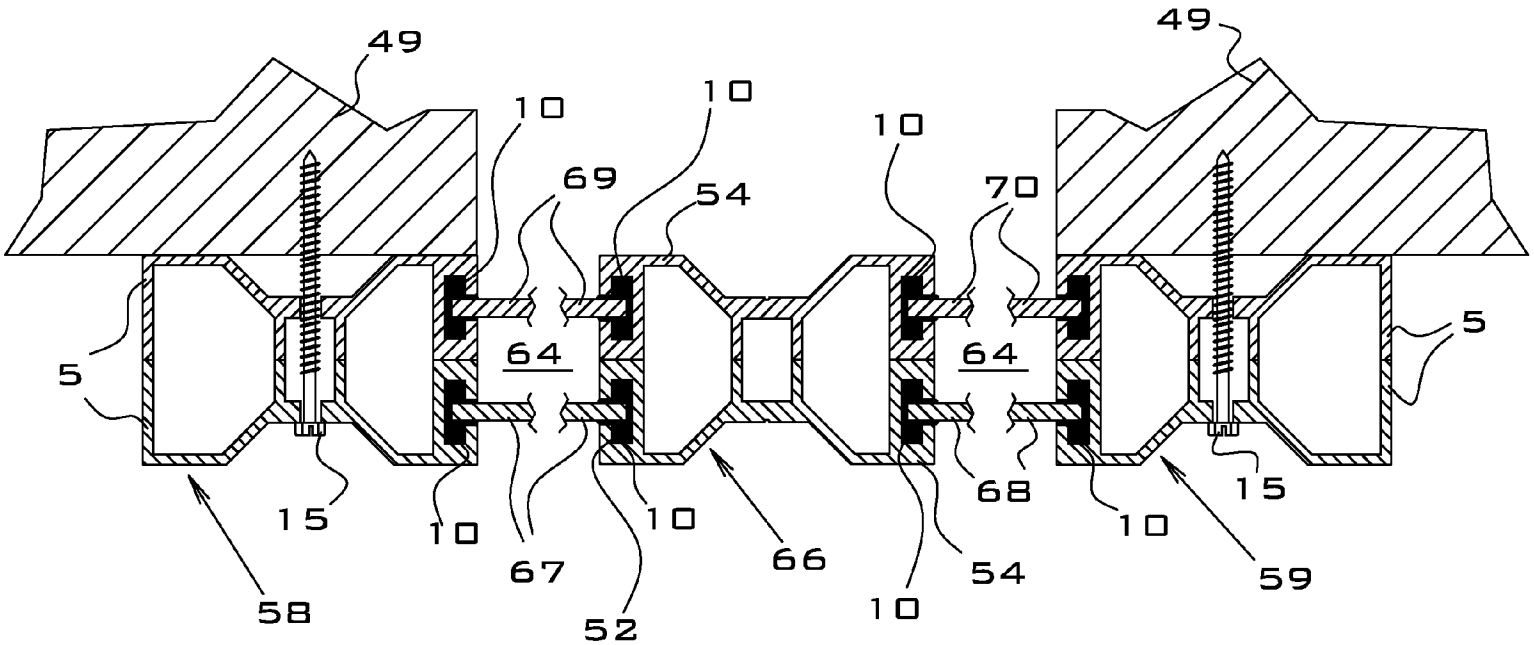
FIG. 20 is a transverse cross-section view of the twelfth embodiment of the present invention, which is the window frame shown in FIG. 19, showing the left side, the right side, and the double-pane internal support member.

FIG. 20 is a transverse cross-section view of the twelfth embodiment of the present invention, which is the window frame shown in FIG. 19, showing the left side 58, the right side 59, and the double-pane internal support member 66. As shown, the left side 58 and the right side 59 are each comprised of two lengths of main frame 5, and the double-pane internal support member 66 is comprised of two lengths of auxiliary internal support member 54 joined back-to-back. The window comprises four separate panes, including an outer left pane 67, an outer right pane 68, an inner left pane 69, and an inner right pane 70. The two left panes 67, 69 are held in receiver channels 10 within the left side 58 of the window frame and the left side of the internal support member 66, while the two right panes are held in receiver channels 10 that are located within the right side 59 of the window frame and the right side of the internal support member 66. The panes 67-70 are secured into place within the receiver channels 10 using adhesive sealant, as described previously in reference to FIG. 13. The sides 58, 59 are attached to the building walls 49 with the attachment screws 15.

Although the preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

The invention claimed is:

1. A weatherguard door sealing device comprising a single piece of metal, wherein the single piece of metal comprises an outer leg, a receiving leg, a center section, a first planar surface, a second planar surface, a first diagonal surface, a second diagonal surface, and two inner reinforcing legs;

wherein the first planar surface connects the outer leg to the first diagonal surface, the first diagonal surface connects the center section to the first planar surface, the second planar surface connects the receiver leg to the second diagonal surface, and the second diagonal surface connects the center section to the second planar surface;

wherein the receiver leg comprises a receiver channel for receiving a sealing element;

wherein the two inner reinforcing legs are parallel to each other and extend perpendicularly from the center section; and wherein each of the first and second planar surfaces, the first and second diagonal surfaces, and the center section has a thickness, and the thickness of the center section is greater than the thickness of the first and second planar surfaces and the first and second diagonal surfaces.

2. The weatherguard door sealing device of claim 1, wherein the receiver channel is T-shaped in cross-section.

3. The weatherguard door sealing device of claim 2, wherein the sealing element has a T-shaped proximal end, a distal end, and a blade section having a base;

wherein the base of the blade section has a thickness, and the distal end of the sealing element has a thickness, and the thickness of the base of the blade section is greater than the thickness of the distal end of the sealing element.

4. The weatherguard door sealing device of claim 3, wherein the base of the blade section comprises a bend having an angle of roughly twenty-five degrees.

5. The weatherguard door sealing device of claim 2, wherein the sealing element is a hollow-bulb sealing element having a T-shaped proximal end, a rubber bulb member, and an air-filled core.

6. The weatherguard door sealing device of claim 2, wherein the sealing element is a brush seal with a T-shaped proximal end and brush fibers.

7. The weatherguard door sealing device of claim 2, wherein the sealing element is a magnetic sealing element with a T-shaped proximal end, a rectangular polymer member, and a magnetic core encapsulated within the rectangular polymer member.

8. The weatherguard door sealing device of claim 1, wherein the receiver channel is round in cross-section.

9. The weatherguard door sealing device of claim 8, wherein the sealing element has a proximal end that is round in cross-section, a distal end, and a blade section having a base;

wherein the base of the blade section has a thickness, and the distal end of the sealing element has a thickness, and the thickness of the base of the blade section is greater than the thickness of the distal end of the sealing element.

10. The weatherguard door sealing device of claim 9, wherein the base of the blade section comprises a bend having an angle of roughly twenty-five degrees.

11. The weatherguard door sealing device of claim 8, wherein the sealing element is a hollow-bulb sealing element having a proximal end that is round in cross-section, a rubber bulb member, and an air-filled core.

12. The weatherguard door sealing device of claim 8, wherein the sealing element is a brush seal with a proximal end that is round in cross-section and brush fibers.

13. The weatherguard door sealing device of claim 8, wherein the sealing element is a magnetic sealing element with a proximal end that is round in cross-section, a rectangular polymer member, and a magnetic core encapsulated within the rectangular polymer member.

14. The weatherguard door sealing device of claim 1, wherein the center section comprises a longitudinal drilling guide groove.

15. A window frame comprising one or more of the weatherguard door sealing device of claim 1.

* * * * *